US005465503A

United States Patent [19]

Oates

[11] Patent Number: 5,465,503

[45] Date of Patent: Nov. 14, 1995

[54] DRYER DENSIFIER

[75] Inventor: Ira O. L. Oates, LaGrange, Tex.

[73] Assignee: The Lerio Corporation, Mobile, Ala.

[21] Appl. No.: 89,626

[22] Filed: Jul. 12, 1993

Related U.S. Application Data

[63] Continuation of Ser. No. 897,809, Jun. 12, 1992, abandoned.

[51] Int. Cl.[6] ..... F26B 11/12

[52] U.S. Cl. ..... 34/179; 34/126; 34/132

[58] Field of Search ..... 34/140, 126, 130, 34/132, 136, 179, 164, 17, 443, 418

[56] References Cited

U.S. PATENT DOCUMENTS

| | | | |
|---|---|---|---|
| 249,978 | 11/1881 | Palmer | 34/132 |
| 1,636,569 | 7/1927 | Jones et al. | 34/179 |
| 2,904,896 | 9/1959 | Forrest et al. | 34/136 |
| 3,401,923 | 9/1968 | Bearce | 34/126 |
| 3,773,873 | 11/1973 | Spaak et al. | 264/37 |
| 3,976,730 | 8/1976 | Cushing | 264/37 |
| 4,029,572 | 6/1977 | Theodore et al. | 34/132 |
| 4,249,906 | 2/1981 | Howell | 23/313 |
| 4,264,543 | 4/1981 | Valenta | 264/37 |
| 4,274,342 | 6/1981 | Nider | 34/130 |
| 4,591,467 | 5/1986 | Kopernicky | 264/37 |
| 4,970,043 | 11/1990 | Doan et al. | 264/237 |
| 5,116,363 | 5/1992 | Romweber | 34/136 |

FOREIGN PATENT DOCUMENTS

| | | | |
|---|---|---|---|
| 2124510 | 11/1972 | Germany | 264/37 |
| 2455987 | 8/1986 | Germany | 264/37 |
| 57-173126 | 3/1983 | Japan | 264/37 |

*Primary Examiner*—Denise L. Gromada
*Attorney, Agent, or Firm*—Roylance, Abrams, Berdo & Goodman

[57] ABSTRACT

A dryer densifier includes a hopper for receiving wet, dry and/or flaky thermoplastic waste material. The hopper feeds an auger barrel which is heated and insulated whereby material passing therethrough may be dried and fused together with other material. The auger barrel and screw are configured to leave sufficient space therebetween whereby heated vapors may pass along the length of the auger and exit to the atmosphere at the discharge end, and whereby the heated vapor may be collected by a vapor collecting hood. The material is discharged from the auger onto a shaker screen table where the fused and unfused materials are separated by the vibrating screen conveyor of the table. The unfused material is returned to the receiving hopper for further densification and the fused material is conveyed to a granulator, whereupon the dried and densified material is granulated.

26 Claims, 1 Drawing Sheet

DRYER DENSIFIER

This is a continuation of application Ser. No. 07/897,809 filed Jun. 12, 1992, now abandoned.

BACKGROUND OF THE INVENTION

1. Field of the Invention

In general, the invention provides a drier densifier. More specifically, the invention discloses an apparatus and process for drying and densifying plastic material.

2. Prior Art

In the handling and processing of thermoplastic materials the occasion often arises that wet or damp materials need to be dried. Thermoplastic material in a wet or damp state cannot be molded or formed into finished plastic articles. Also, materials are many times in very low bulk density form such as powder or flake and need to be converted to higher bulk density form (i.e., densified). Material in very low bulk density is extremely difficult to process into plastic articles. It is also difficult to convey or transport and expensive to ship due to its low weight per volume.

When thermoplastic materials are produced, the virgin resin is often in a powder form before being extruded into pellets. All plant spillage and waste must be collected, washed, dried and densified to be suitable for use in plastics manufacturing. The processes involved in the manufacturing and finishing of plastic articles frequently produce waste that is fine low bulk density regrind, flake, shavings or dust (e.g., blow molding processes may generate 30 to 50% waste material depending upon the plastic part being formed). Very often this waste must be washed, dried and densified in order to be processed in a secondary operation or sold to a thermoplastic brokerage market as a usable by, product. Furthermore, facilitating reuse of thermoplastic waste material may be beneficial from economic and energy viewpoints since reground waste material can often be extruded at temperatures 10°–20° F. lower than the extrusion temperatures necessary with virgin resin.

A variety of attempts have been made to solve these drying and densification problems. For example, U.S. Pat. No. 4,591,467 to Kopernicky ("Kopernicky") discloses a method for removing moisture and volatiles from molding particulate plastic material feed. Kopernicky teaches the use of flow control means to drop a controlled amount of particulate thermoplastic material into the input end of a plasticizing screw. In order to draw off the hot volatile vapors which are released as the material is gradually melted and compressed by the screw, suction means are operatively associated with the input end of the barrel. The feed-rate of particulate material is restricted so that the barrel of the plasticizing screw is only partially filled near the opening, thereby improving the withdrawal of gases from the barrel. Kopernicky calls for extensive heating (e.g., preheating) and melting (e.g., column 4, lines 13 to 16: "The heat, pressure and shearing forces melt the particles layer by layer gradually releasing the moisture and other volatile as a vapor which flow out of opening 14"). No shaker screen table is disclosed, nor is any reprocessing of non-densified/dried material disclosed.

U.S. Pat. No. 4,970,043 to Doan et al. ("Doan et al.") discloses a process for forming thermoplastic material from granular scrap material. Doan et al. teaches the formation of moldable material from a mixture of granular scrap materials (e.g., reground rubber and a thermoplastic polymer). The material is processed in an extruder under sufficient pressure and temperature (e.g., column 3, lines 49 to 52:500 to 1800 psi and 350° to 500° F.) to form a semi-stable moldable product. The moldable product is subsequently molded. Doan et al. does not provide for reprocessing non-densified/dried material (but rather appears to mandate longer residence times). Finally, Doan et al. does not appear to disclose a partially-filled auger (whereby vapor may escape) since Doan et al. appears to rely upon screw/jacket friction to generate a large part of the high processing temperatures.

U.S. Pat. No. 3.976,730 to Cushing ("Cushing") discloses a method of employing a high percentage of reground thermoplastic resin in an extruder. Cushing teaches mixing virgin polyethylene pellets with low density polyethylene scrap and compressing and melting the mixture within an extruder to form the raw material for newly-molded thermoplastic articles.

While these devices have alleviated many problems, several issues, especially the suboptimization inherently represented by complete melting and imparting of an additional "heat history" with respect to the plastic material have until now not been satisfactorily addressed. The inventive dryer densifier provides a machine uniquely suited to the needs of the plastics industry. This machine will not only densify material of low bulk density, dry material of either high or low bulk density but will accomplish both at the same time and at any mix ratio.

SUMMARY OF THE INVENTION

The present invention solves the above-noted problems and suboptimizations by providing an inventive dryer densifier comprising a hopper for receiving thermoplastic waste material (e.g., wet, dry, flaky, powdery, etc.). The material is feed from the hopper to an enclosed chamber by an auger. The chamber is heated and insulated whereby material passing therethrough may be dried and fused together with other material. The chamber and auger are configured to leave sufficient space therebetween whereby heated vapors may freely pass along the length of the auger and exit to the atmosphere at the discharge end of the chamber. A vapor collecting hood is provided near the discharge orifice of the chamber to capture vapors leaving the chamber. The material is discharged from the auger onto a shaker screen table where the fused and unfused materials are separated by the vibrating screen conveyor of the table. The unfused material is returned (via an auger) to the receiving hopper for further densification and the fused material is conveyed to a granulator, whereupon the dried and densified material is granulated.

The present invention dries and densities wet or damp granular, powdery or fluffy thermoplastic materials in one operation. The process preferably does not totally melt the material since this would give rise to another "heat history" within the material which might be detrimental in later processing.

Wet or damp thermoplastic material in granular, powdered, regrind, or fluff state is introduced into the machine receiving hopper by an appropriate mechanical means. The material exits the bottom of the hopper into the screw auger. As the material progresses through the auger chamber/barrel it is heated. The heat is generated by electric heater bands placed around the outside of the auger tube or barrel. The heat is confined to the tube area by an insulated enclosure surrounding the tube and heater bands. Plastic material touching the barrel is heated by conduction. As the auger turns, different material contacts the barrel and is heated.

As the damp plastic material is heated, some of the liquid is vaporized. This vapor then becomes a vehicle for conducting heat as it progresses through the barrel to the discharge end. The material within the barrel is heated by this vapor until it exits the discharge end to the atmosphere. Any excess heated vapors are free to progress through the barrel and exit due to the clearance between the barrel and screw, the permeability/porosity of the material being dried/densified and the fact that the discharge end is open to atmospheric pressure. Therefore, the amount of wetness of the material may vary from slightly damp to dripping wet. Excess water may exit the entrance of the auger as a stream of liquid. Material that is dripping with water or water poured into the feed hopper will not adversely affect the process.

The material acquires more heat as it travels through the heated auger barrel. Some of the material becomes melted and fuses together with other melted and unmelted material forming lumps, strings or scalings. This fused material is wiped from the interior surface of the barrel by the rotating action of the auger and conveyed to the discharge end. As the material exits the barrel, there is a mixture of fused material (lumps, strings and scalings) and unfused material. This unfused material may be dry or damp and is separated from the fused material by a vibrating screen conveyor table.

The vibrating screen conveyor deposits the fused material on an accumulating conveyor which transports the material to a standard plastics granulator. Plastic regrind material is then produced as the finished product. The vibrating screen conveyor also deposits the unfused material into an auger which returns this material to the machine receiving hopper. This material and its retained heat are recycled into the heated auger. In this manner, substantially all of the thermoplastic material becomes densified and much of the heat is retained for a more efficient operation.

Thus, the invention accomplishes the drying and densifying of thermoplastic materials in one operation with conservation of heat energy and without ever totally melting the thermoplastic material.

BRIEF DESCRIPTION OF THE DRAWING

The preferred apparatus and method of the present invention may be further understood through consideration of the following non-limiting detailed description, particularly when reviewed in conjunction with the appended FIGURE in which a preferred embodiment of the inventive apparatus is represented schematically.

DETAILED DESCRIPTION OF THE PREFERRED EMBODIMENT

Figure 1:
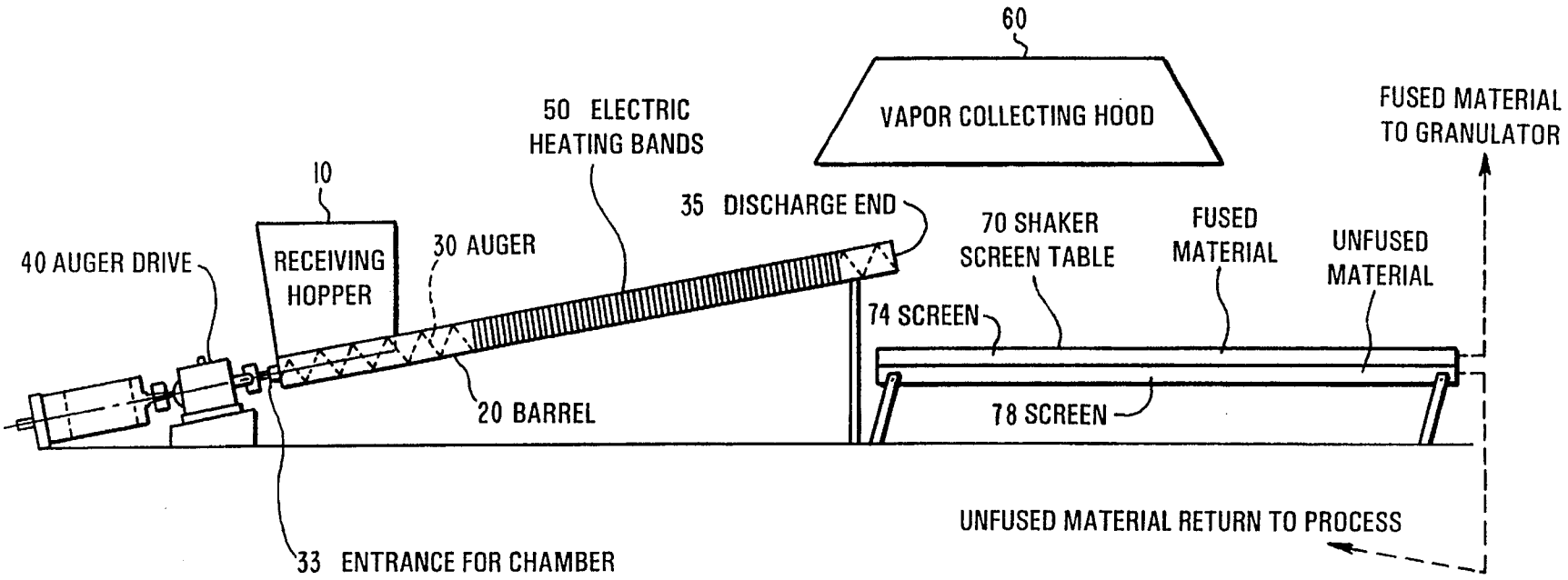

Referring now to the drawing, wherein like numerals represent like elements throughout, there is shown a preferred embodiment of the inventive dryer densifier.

1. Apparatus

The inventive dryer densifier provides a mechanism for drying and densifying plastic materials, especially thermoplastic materials. The dryer densifier includes a receiving hopper 10 into which may be fed the thermoplastic material (e.g., in wet, dry, flaky, powdered or other form-thermosetting materials may also be processed with the inventive drier/densifier, but they will only be dried, not melted/densified). The plastic material is conveyed from the hopper 10 to an auger barrel/chamber 30 by any suitable conveying means. Normally the plastic material merely falls from the hopper 10 to the conveying means under the force of gravity, but if desired, auxiliary feeder means may be used to speed the flow of material from the hopper 10 to the conveying means. Preferably, the conveying means comprises an auger 20. More preferably, the auger 20 is operatively associated with a suitable mechanism for rotating the auger 20 at variable speeds, e.g., a motor/drive train 40. The motor/drive train 40 may also include back-up electrical and/or mechanical means to turn the auger 20 and empty the plastic material being processed from the chamber 30 in the event of a power failure (e.g., since heated polyethylene trapped within the chamber could otherwise be a serious fire hazard). Normally, however, back-up means for turning tile auger 20 are not required (e.g., since the material within the barrel 30 is substantially not melted).

As is well known in the conveying/extruder art, the specific configuration of the auger 20 may be extensively modified/specialized to produce the desired effect upon the plastic material being conveyed through the chamber 30 (e.g., increasing or decreasing the amount of incising of the plastic material, speeding up or retarding the progress of the material through the chamber, altering the intensity of the mixing, etc.). The particular auger 20 configuration utilized may preferably be optimized to facilitate drying and densification of the expected feed material. More preferably, however, the auger 20 is sized to fit within the chamber 30 somewhat loosely, whereby any humid vapors generated by the dryer/densifier may pass along the length of the chamber 30 relatively unimpeded. The chamber 30 wall to auger 20 clearance may be as little as 0.008 to 0.015 inches (i.e., the mechanical limits for producing augers). These relatively tight chamber wall-auger tolerances are permissible because adequate movement of the heated vapors may occur through the pore spaces/voids within the plastic material being dried/densified within the chamber 30. The movement of the heated vapors is further facilitated since the chamber 30 is not normally completely filled with plastic material, and hence, the vapors may normally travel along the chamber 30 within the void space around the auger 20. Conversely, the chamber 30 wall-auger 20 space may be much larger; e.g., as long as the auger 20 is able to wipe the plastic material from the chamber 30 wall before it fully melts.

By allowing the heated vapors to move relatively freely through, and out of, the chamber 30, several benefits are obtained. For example, drying of the plastic material is facilitated by providing a mechanism for removing the moist vapor from the vicinity of the plastic material (i.e., along the walls of the chamber 30, between the chamber 30 and the auger 20, towards and along the threads of the auger 20, etc.). By allowing moist vapor to leave the vicinity of the thermoplastic material, further evaporation of moisture from the material is facilitated. Secondly, by allowing the heated, moist vapor to freely progress through the chamber 30 (i.e., to be dispelled at the discharge end 35 of the chamber 30), the vapor may become a vehicle for conducting heat as it progresses through the chamber 30—further augmenting the drying and densifying properties of the apparatus. Finally, by allowing the moist vapors associated with the plastic material to freely pass along and out of the chamber 30 (as opposed to maintaining the vapor within the chamber 30) the plastics resins being dried/densified can be protected from oxidation and the upper temperature attained within the chamber 30 can be limited, both to promote uniform levels of drying and densification within the material and to help prevent localized melting of the plastic material (which, in turn, could lead to the formation of additional "heat histories" within the dried/densified plastic which could cause the material to be weakened and/or wear more easily than normal).

The amount of space required between the auger 20 and the chamber 30 to allow for free flow of the moist vapors through and out of the chamber will vary depending upon a variety of factors, e.g., the type of materials being dried and densified, the throughput rate of the material relative to the chamber 30, the auger screw 20 configuration, etc. Because of the ability of the heated vapors to travel through the pore space within the plastic material, the chamber 30 may be fully loaded with material during the inventive drying-densifying process. More preferably, however, the amount of plastic being brought into the chamber 30 (i.e., by the auger 20) is controlled (e.g., by constricting the movement of the material out of the hopper 10, controlling the configuration of the auger screw 20, etc.) so that the plastic material does not fill the chamber 30. Most preferably, the plastic material does not occupy more than about one-half of the space available around the auger 20, within the chamber 30. Furthermore, in order to maintain the beneficial effects of the heated vapors passing through the chamber and to lessen the risk of fire, the chamber 30 is preferably not vented along its length.

Unlike many previously-developed devices, the inventive dryer/densifier does not substantially rely upon friction created between the auger 20 and the inside wall of the chamber 30 to create heat for drying/densifying the material. Rather, heating means 50 are affixed to the chamber 30 to facilitate densification of the plastic material as it passes therethrough. Preferably, electric coils 50 are used to heat the material within the chamber 30. More preferably, the electric coils 50 are covered by suitable enclosure means to help maintain the safety of workers using the inventive dryer densifier. In alternate embodiments of the invention, e.g., wherein multiple augers 20 (e.g., co- or counter-rotating) are employed, an oven structure may be configured around the auger chamber 30 to provide heat to the chamber 30 and material being dried/densified.

The inventive dryer/densifier preferably also includes a vapor collecting hood 60 for collecting the vapors exiting the discharge end 35 of the chamber 50, i.e., since some of the fumes generated by even partial melting of plastic material can be quite noxious.

Once the plastic material has passed through the chamber 30, the material is transferred to a sorting device. A wide variety of sorting devices may be used, but a shaker screen table 70 has proven to be quite useful in sorting the material which has passed through the chamber 30 into more- and less-fully dried and densified material. Vibrating (or "shaker") screen tables are well known by those involved in fields calling for separation of material by particle size. For example, U.S. Pat. No. 4,264,543 to Valenta (which is hereby incorporated by reference) discloses a process for producing absorbent granules of gypsum in a preferred size range wherein the pellets are separated by size by a series of vibrating screens (52, 53, 54). Also, U.S. Pat. No. 4,249,906 to Howell (which is hereby incorporated by reference) discloses the use of screening means to separate flux fine particles.

The particular specifies of the shaker screen table utilized to separate the more- and less-fully dried and densified plastic materials from each other are not particularly important. As discussed in the above-noted references, a shaker screen table 70 having a plurality of metal screens can be quite effective in separating larger (i.e., more-fully densified) pieces of plastic from smaller (i.e., less-fully densified) pieces of plastic. The screens should have a variety of different mesh sizes (and should be arranged vertically from the largest mesh (on top) to the smallest mesh screen (on the bottom). Any number of screens may be used, but (as shown in the figure) two sets of screens have been proven to work quite well. For example, the top screen 74 of the shaker screen table 70 may have ½ inch openings, whereby pieces of fused/densified plastic larger than ½ inch will not pass through the screen 74 but rather will be shaken around (thereby facilitating cooling of the plastic) until they reach a suitable means for conveying the pieces to a granulator (or other suitable piece of processing equipment), e.g., a conveyor belt.

The pieces of plastic which do fall through the upper screen 74 will land on a smaller mesh size (e.g., ⅛ inch openings) screen. The lower screen 78 preferably also vibrates, facilitating further drying of the material. At the end of the lower (or lowermost, in the case of more than two screens) screen, the dryer densifier preferably includes a suitable mechanism for returning this less-fully densified material to the hopper 10 whereby the material may be processed again and densified more fully.

The shaker screen table 70 is preferably configured to facilitate movement of the more- and less-fully dried and densified material along the screen table away from the discharge end 35 of the chamber 30 and toward the feed mechanisms for the granulator (for the more-fully densified material) and the return to the hopper 10 (for the less-fully densified material). This motion may be facilitated by inclining the shaker screen table downwards away from the discharge end 35 of the chamber 30. Alternatively, other shaker screen tables are capable of moving material along the length thereof by controlling the pitch or wave-form of undulations induced in the screens. These types of shaker screen tables often do not need to be inclined to move material along the length thereof.

Furthermore, the screens of the shaker screen table 70 are preferably removable whereby the more- and less-fully densified material may be separated at different levels of densification.

2. Process

In the process of drying and densifying plastic material through the use of the inventive dryer densifier, plastic material (i.e., wet/dry, flaky/powdery/shavings/chunky, etc.) is feed to the receiving hopper 10 (e.g., by any suitable electro-mechanical mechanism). Thereafter, appropriate amounts of the plastic material are conveyed from the receiving hopper 10 to the chamber 30 by an auger 20.

The auger is preferably configured so that excess amounts of plastic material are not allowed to enter the chamber 30. Because of the pore spaces within the plastic material being dried/densified, the space between the auger 20 and chamber wall 30 and the spaces between augers 20, heated vapors may move freely within and through the chamber 30 even when the chamber 30 is fully loaded with plastic material. Hence, vapor velocity within the chamber 30 is not limited by auger 20 rotational speed. More preferably, however, a significant portion (e.g., one half) of the available volume within the chamber 30 (i.e., relative to the space which is not taken up by the auger 20) is allowed to remain free of plastic material. This free space allows moist heated vapors to move relatively freely through the chamber 30.

As the material progresses through the chamber 30 it is heated. The heat may be preferably generated by electric heater bands 50 placed around the outside of the auger chamber or barrel 30 (any suitable heat-generating mechanism may be used, however). The heat is preferably confined to the tube area by an insulated enclosure surrounding the chamber 30 and heater bands 50. Plastic material touching the chamber barrel is heated by conduction. The short residence times (e..g, a few seconds) incident to the inventive process insure that true/complete melting of a majority of the material does not occur. As the auger 20 turns, different material contacts the barrel and is heated. As this damp material is heated, some of the liquid is vaporized. This vapor then becomes a vehicle for conducting heat as it progresses through the chamber 30 to the discharge end 35. The material within the chamber 30 is heated by this vapor until it exits the discharge end 35 to the atmosphere. Any excess heated vapors are continually free to progress through the barrel and exit due to the porosity/permeability of the material, the clearance between the barrel 30 and auger screw 20 and the fact that the discharge end 35 is open to atmospheric pressure. This free movement/discharge of vapor prevents pressure from building within the chamber (e.g., as in a standard plastics extruder) and avoids the problems associated with pressurized operation (e.g., foaming, water entrapment, hydrolytic polymer breakdown, sputtering at the discharge end of the chamber, etc.). Therefore, the amount of wetness of the material may vary from slightly damp to dripping wet. Excess water may exit the chamber 30 at the entrance 33 for the auger 20 as a stream of liquid. Material that is dripping with water or water poured into the feed hopper 16 will not adversely affect the process. In fact, to avoid stalling the auger 20 and to assure the heat-transferral benefits of the vapor, some water is necessary within the material fed to the receiving hopper 10. Preferably, at least about five percent (but less than 50 percent) by weight of the material fed to the receiving hopper 10 comprises water/liquid. More preferably, about 10 to about 30 percent by weight of the feed material comprises water/liquid. Most preferably, between 10 and 15 percent by weight of the material fed to the receiving hopper 10 comprises water/liquid. Alternatively, however, it has proven possible to use the inventive dryer densifier as substantially a dedicated densifier (i.e., with dry feed material—e.g., powder) as long as about one percent by weight of the feed material comprises mineral oil (i.e., to facilitate auger 20 rotation).

The material acquires more heat as it travels through the heated chamber 30. Some of the material becomes melted and fuses together with other melted and unmelted material, forming lumps, strings or scalings. This fused material is wiped from the chamber walls 30 (i.e., the interior surface of the barrel) by the rotating action of the auger 20 and conveyed to the discharge end 35.

As the material exits the barrel, it comprises a mixture of fused material (lumps, strings and scalings) and unfused (or partially fused) material. The less-fully densified material may be dry or damp and is separated from the fused material by a vibrating screen conveyor table 70 or other suitable transport/separating means.

The vibrating screen table 70 preferably deposits the more-fully densified material on an accumulating conveyor which transports the material to a standard plastics granulator. Plastic regrind material is then produced as the finished product. The vibrating screen conveyor 70 also deposits the less-fully densified or unfused material onto a suitable means for returning this material to the machine receiving hopper 10. This less-fully densified material and its retained heat are recycled into the heated auger. In this manner, substantially all of the thermoplastic material eventually becomes densified and much of the heat is retained for a more efficient operation.

Thus, the invention accomplishes the drying and densifying of thermoplastic materials in one operation with conservation of heat energy and substantially without ever totally melting the thermoplastic material—i.e., because only a thin layer of material (e.g., against the barrel 30 wall) actually melts/fuses before the material is wiped away. Complete melting of the material is avoided because when thermoplastic materials become totally melted, another "heat history" is added to the material which may be detrimental to the properties of the material.

In general, the process of the present invention is primarily controlled by controlling the rotational speed (rpm) of the auger 20, the temperature of the input, the moisture content of the material and the cut-off size of the rejected (i.e., less-fully densified) material returned to the receiving hopper 10. These parameters will vary widely according to the particular type of material being processed, but in general, it has been noted that higher rotational velocities for the auger 20 generate more relatively smaller dried/densified materials, whereas lower auger rpm produce more relatively larger fused lumps/particles, etc. (all other parameters being optimized). Auger 20 rotational velocities will, of course, vary widely depending upon the input material, etc., but an auger velocity of 18 to 22 rpm has proven to work well with a wide variety of operating conditions.

It is important to remember that the specific machining parameters used in the inventive drying/densifying process will vary widely according to such factors as: the composition of the input material (i.e., both physical—e.g., flake, powder, chuck, etc. and chemical—e.g., polypropylene, polyethylene, etc.), moisture level of the input material, extent of loading of the chamber 30 (e.g., fully filled or only one-half filled), desired size of output dried/densified material, etc. Hence, the preferred operating parameters will vary widely for specific applications of the inventive process. Nevertheless, in general, it has been found that the exterior of the chamber 30 should have a temperature of between 600° to 1200° F. when polyolefins are being dried/densified, i.e., about 600° to 800° F. when the input plastic material has a moisture 20 to 30% by weight. To achieve desired melting/fusing levels, the interior wall of the chamber 30 should have a temperature of about 300° to 350° F. for polypropylene and from about 350° to 400° F. for polyethylene (i.e., when mixtures of polypropylene/polyethylene are being dried/densified, the preferred chamber 30 inner wall temperature will vary accordingly).

The inventive drier/densifier apparatus and process will now be further explained by reference to the following, non-limiting, examples.

Example 1

A chamber having a 9 inch diameter auger was employed. The input material to the receiving hopper comprised high-density polyethylene powder having a moisture content of about 20 percent by weight. The chamber/barrel had an exterior temperature of about 625° F. and an interior temperature of about 400° F. The chamber was loaded such that it was about 60 percent full of material during processing. The auger was rotated at from 18 to 22 rpm. The material had an average residence time within the chamber of about 10 seconds. About 65 percent of the output material was 0.5 inches or larger in size (i.e., largest dimension) and was sent to the granulator (i.e., about 35 percent of the material was found by the shaker screen table to be below 0.5 inches in size and was recycled to the input hopper). About 900 pounds of dried/densified material was produced (and sent to the granulator) per hour.

Example 2

A chamber having a 9 inch diameter auger was employed. The input material to the receiving hopper comprised polypropylene powder having a moisture content of about 15 percent by weight. The chamber/barrel had an exterior temperature of about 600° F. and an interior temperature of about 350 ° F. The chamber was loaded such that it was about 70 percent full of material during processing. The auger was rotated at from 20 to 22 rpm. The material had an average residence time within the chamber of about 10 seconds. About 70 percent of the output material was 0.5 inches or larger in size and was sent to the granulator (i.e., about 30 percent of the material was found by the shaker screen table to be below 0.5 inches in size and was recycled to the input hopper). About 1000 pounds of dried/densified material was produced (and sent to the granulator) per hour.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modification and equivalent arrangements, the present invention being limited only the claims appended hereto and the equivalents thereof.

I claim:

1. An apparatus for drying and densifying plastic material comprising:

(a) a receiving hopper for holding said material;

(b) a stationary chamber;

(c) means for conveying substantially all said material from said hopper to and through said chamber, said material being in contact with said chamber as said material is conveyed through said chamber; and (d) means for heating said chamber and fusing at least a portion of said material while it is inside said chamber, thereby substantially drying and densifying said material;

said chamber including an orifice for discharging said heated material;

said conveying means extending from said hopper and through said chamber to said discharge orifice for conveying said material through said chamber; and sorting means receiving said material from said discharge orifice for sorting said material into more- and less-fully dried and densified fractions, said sorting means comprising a plurality of vibrating screens, said plurality of vibrating screens being arranged vertically from top to bottom in a sequence of decreasing mesh sizes, whereby the more-fully densified material will be larger and rest on the upper of said vibrating screens and the less-fully densified material will be smaller and fall through the upper of said vibrating screens and be retained by one of said lower, smaller mesh, vibrating screens.

2. The drying and densifying apparatus of claim 1 wherein said conveying means is an auger extending substantially the length of said chamber.

3. The drying and densifying apparatus of claim 2 wherein said auger is smaller than the inside of said chamber, whereby vapors from said material within said chamber may pass between said chamber and auger and exit said chamber through said orifice.

4. The drying and densifying apparatus of claim 3 wherein said auger is operatively associated with means for rotating said auger at variable speeds.

5. The drying and densifying apparatus of claim 4 wherein said heating means comprises heating elements affixed to the exterior of said chamber.

6. The drying and densifying apparatus of claim 3 further comprising:

(e) means for substantially collecting the vapor exiting said chamber through said orifice.

7. The drying and densifying apparatus of claim 1 further comprising means to convey said less-fully densified material from said lower of said vibrating screens to said hopper, whereby the density of said material may be further increased.

8. The apparatus of claim 1, wherein said conveying means is sized in relation to said chamber to effect heat transfer from said heating means to said material.

9. The apparatus of claim 1, wherein said chamber includes an inlet, said conveying means being disposed in said inlet to substantially close said inlet for preventing air from entering said chamber.

10. The apparatus of claim 1, wherein said chamber is closed along its length to prevent a flow of air from entering said chamber and preventing ignition of said material.

11. The apparatus of claim 1, wherein said conveying means agitates said material while being conveyed to enhance contact with said heated chamber.

12. A process for drying and densifying material, a substantial portion of said material comprising plastic material, said process comprising:

(a) feeding material into a hopper;

(b) conveying said material from said hopper to a stationary heated chamber and heating said material without introducing a flow of air to said chamber for preventing ignition of said plastic material;

(c) allowing heated vapors from said plastic material to freely pass along and out of said chamber, whereby humid vapor is allowed to move away from said material and whereby heat transfer within said material is facilitated;

(d) conveying said material through said chamber while said material is in contact with said chamber to fuse at least a portion of said material and to substantially dry and densify said material;

(e) causing said material to exit said chamber downstream of said hopper and sorting said substantially dried and densified material into at least two more- and less-fully dried and densified fractions; and separating unfused material from said dried and densified material and returning said unfused material to said heated chamber.

13. The process of claim 12 further comprising adding at least five percent by weight liquids or water to said plastic material prior to said heating step.

14. The process of claim 12 wherein said material is essentially moisture-free and said process further comprises adding at least about one percent by weight mineral oil to said plastic material prior to said heating step.

15. The drying and densifying process of claim 12, further comprising the step of:

(f) substantially capturing and removing said humid vapors exiting said chamber.

16. The process of claim 12, wherein said conveying and heated steps are substantially without introducing a flow of air for preventing ignition of said material.

17. The process of claim 12, wherein said material contains at least 5% water.

18. The process of claim 12, wherein said material contains 5–50 wt % water.

19. The process of claim 12, wherein said heating step is carried out without completely melting said plastic material to a liquid.

20. A process for drying and densifying plastic material comprising:

conveying said plastic material through a heated chamber and heating said material without a flow of air through said chamber for preventing ignition of said plastic material, conveying heated vapors from said plastic material along and out of said chamber, whereby humid vapor is carried away from said material and whereby heat transfer within said material is facilitated, conveying said material through said chamber to substantially dry and densify said plastic material, and discharging said material to a sorting device and sorting said material into at least two more- and less-fully dried and densified fractions, said sorting step comprising feeding said substantially dried and densified material onto a plurality of vibrating screens, said plurality of screens being arranged vertically from top to bottom in a sequence of decreasing mesh sizes, whereby the more-fully dried and densified material will be larger and will rest on the upper of said vibrating screens and whereby the less-fully densified material will be smaller and fall through the upper of said vibrating screens and be retained by one of said lower, smaller mesh, vibrating screens.

21. The drying and densifying process of claim 20 further comprising the step of conveying said less-fully dried and densified material from said lower of said vibrating screens to said hopper, whereby the density of said material may be further increased.

22. A process for drying and densifying plastic material, said process comprising:

conveying said plastic material through a heated chamber and heating said material by contacting said material with a surface of said chamber to fuse at least a portion of said material and to substantially dry and densify said material without introducing a flow of air to said chamber for preventing ignition of said plastic material, conveying heated vapors from said plastic material along and out of said chamber, whereby humid vapor is carried away from said material and whereby heat transfer within said material is facilitated, discharging said material from said chamber and sorting said substantially dried and densified material into at least two more- and less-fully dried and densified fractions, and conveying said more-fully dried and densified material to a means for granulating said material and granulating said material.

23. An apparatus for drying and densifying plastic material comprising:

(a) a receiving hopper for holding said material;

(b) a stationary heated chamber, said chamber including at least an input and an output orifice and a side wall substantially without openings to prevent an inflow of air and ignition of said material;

(c) means for conveying said material from said hopper to said input orifice of said chamber and for conveying said material completely through said chamber to said output orifice, whereby, during said conveyance through said chamber, said material is at least partially dried and densified;

(d) means for sorting said at least partially dried and densified material operatively associated with said chamber, whereby after said partially dried and densified material has exited said chamber through said output orifice, said material comes in contact with said sorting means, whereby a more-fully dried and densified portion of said material may be separated from a less-fully dried and densified portion of said material; and means for conveying said less-fully dried and densified material to said hopper and further densifying said material.

24. The drying and densifying apparatus of claim 23 wherein said means for conveying said material through said chamber is sized to allow humid vapors to move through said chamber and to exit said chamber through said output orifice, whereby removal of moisture from said material and heat transfer within said material is facilitated.

25. The drying and densifying apparatus of claim 24 wherein said sorting means comprises a plurality of vibrating screens, said plurality of vibrating screens being arranged vertically from top to bottom in a sequence of decreasing mesh sizes, whereby the more-fully densified material will be larger and rest on the upper of said vibrating screens and the less-fully densified material will be smaller and fall through the upper of said vibrating screens and be retained by one of said lower, smaller mesh, vibrating screens.

26. A process of drying, fusing and densifying plastic material comprising:

feeding a plastic material containing at least 5 wt % water to a stationary heated chamber having a rotating auger extending from an inlet end to an outlet end of said heated chamber, said auger being spaced from said heated chamber to allow vapors from said plastic material to pass between said auger and heated chamber while conveying said plastic material;

heating and conveying said material through said heated chamber without completely melting said material and without introducing a flow of air to said chamber for preventing ignition of said plastic material and to dry and densify said material by fusing particles of said material;

discharging said dried and densified material;

separating said dried and densified material into a first less densified fraction and a second more densified fraction; and conveying said first fraction to said heated chamber and further densifying said fraction.

* * * * *